US005344191A

United States Patent [19]

Chang et al.

[11] Patent Number: 5,344,191

[45] Date of Patent: Sep. 6, 1994

[54] HIDDEN ENTRY SYSTEM AND USE THEREOF

[75] Inventors: John C. H. Chang, Naperville; Peter A. Walter, Schaumburg, both of Ill.

[73] Assignee: Wallace Computer Services, Inc., Hillside, Ill.

[21] Appl. No.: 987,694

[22] Filed: Dec. 9, 1992

[51] Int. Cl.[5] ..... B42D 15/00

[52] U.S. Cl. ..... 283/72; 283/87; 283/94; 283/904

[58] Field of Search ..... 283/57, 58, 67, 87, 283/91, 92, 93, 94, 95, 902, 903, 904

[56] References Cited

U.S. PATENT DOCUMENTS

| | | | |
|---|---|---|---|
| 3,713,861 | 1/1973 | Sharp | 117/15 |
| 3,829,133 | 8/1974 | Smagala-Romanoff | 283/6 |
| 4,037,007 | 7/1977 | Wood | 428/199 |
| 4,109,047 | 8/1978 | Fredrickson | 428/307 |
| 4,175,774 | 11/1979 | Tonges et al. | 283/6 |
| 4,183,989 | 1/1980 | Tooth | 428/195 |
| 4,186,020 | 1/1980 | Wachtel | 106/22 |
| 4,210,346 | 7/1980 | Mowry, Jr. et al. | 283/8 B |
| 4,303,307 | 12/1981 | Tureck et al. | 350/276 R |
| 4,360,548 | 11/1982 | Skees et al. | 428/29 |
| 4,376,887 | 3/1983 | Greenaway et al. | 283/904 X |
| 4,488,646 | 12/1984 | McCorkle | 283/94 |
| 4,505,498 | 3/1985 | Weinberger | 283/904 X |
| 4,726,608 | 2/1988 | Walton | 283/96 |
| 4,846,502 | 7/1989 | Chang et al. | 283/57 |
| 5,193,854 | 3/1993 | Borowski, Jr. et al. | 283/93 X |

FOREIGN PATENT DOCUMENTS

| | | | |
|---|---|---|---|
| 2722427 | 5/1977 | Fed. Rep. of Germany . | |
| 2913321 | 4/1979 | Fed. Rep. of Germany . | |
| 2227794 | 10/1987 | Japan | 283/87 |
| 2122995 | 5/1990 | Japan | 283/904 |
| 9100390 | 1/1991 | PCT Int'l Appl. . | |
| 1520919 | 12/1975 | United Kingdom . | |
| 2188283 | 9/1987 | United Kingdom | 283/87 |

*Primary Examiner*—Paul A. Bell

*Attorney, Agent, or Firm*—Roylance, Abrams, Berdo & Goodman

[57] ABSTRACT

A hidden entry system comprises a document having a localized coating of a non-pressure sensitive heat activated autogenous chromogenic composition to provide a latent image which reveals hidden indicia when heated at moderate temperatures. The hidden entry system is especially useful for contests and promotional forms. Quickly striking the chromogenic composition with a fingernail or blunt object converts the latent image to a visible colored image by frictional heat. The chromogenic composition contains a chromogenic compound and a color developer which are non-pressure sensitive and non-reactive at room temperature. The latent image can be provided by an intimate mixture of the chromogenic compound and the developer or alternatively, one component can be printed on a separate layer or coating of the other component.

31 Claims, 2 Drawing Sheets

HIDDEN ENTRY SYSTEM AND USE THEREOF

CROSS-REFERENCE TO RELATED APPLICATION

Reference is made to co-pending application Ser. No. 07/987,710 entitled "Heat Sensitive System and Use Thereof" to John C. H. Chang filed of even date, the disclosure of which is hereby incorporated by reference.

FIELD OF THE INVENTION

The present invention is directed to a hidden entry system for maintaining information hidden until utilized by the intended person. More particularly, this invention relates to documents having a localized heat sensitive chromogenic coating that can be activated by heat to produce visible colored indicia.

BACKGROUND OF THE INVENTION

Various methods have been proposed for preparation of sweepstakes contest awards, lottery tickets, promotional game cards, premium cards, and the like, containing hidden entries, such as numerals, messages, symbols, or the like, which can be revealed to the recipient by various means.

For example, U.S. Pat. No. 4,726,608 to Walton discloses the use of an opaque coating over hidden indicia. The image of the indicia is later made visible by scratching off the opaque coating or by applying a solvent to disperse the coating. This system has the disadvantages of either requiring extraneous solvents or producing unwanted dust.

Co-pending U.S. application Ser. No. 07/987,710 to John C. H. Chang entitled "Heat Sensitive System and Use Thereof" filed on even date herewith, the disclosure of which is hereby incorporated herein by reference, discloses a heat sensitive chromogenic system in the production of documents to prevent unauthorized or fraudulent use of a xerographic color copier for reproduction of negotiable instruments, such as checks, money orders and the like. When, for example, a check bearing the heat sensitive chromogenic coating in a verification thereof is presented for payment, the bank teller can simply apply heat to the verification area, and if a visible image symbol appears in the verification area, the teller will know that the check is an original.

SUMMARY OF THE INVENTION

A hidden entry system has now been discovered which can be used to provide hidden indicia on a document used, for example, in a contest or promotion, such as sweepstakes contest awards, lottery tickets, premium cards, promotional game cards, or the like, to hide indicia, which system comprises a support having an information area bearing a localized coating of a heat activatable chromogenic composition, said localized heat activatable chromogenic coating providing a latent image of indicia which is convertible to a visible colored image by application of heat. Surprisingly, it has been found that by using a localized coating of a non-pressure sensitive, heat activatable chromogenic composition for revealing hidden indicia in, for example, a sweepstakes award, premature revelation of the hidden indicia by pressure is avoided. Moreover, production of unwanted dust or debris or use of extraneous solvents is avoided, since activation of the chromogenic coating is effected by application of heat.

According to one embodiment of the present invention, the hidden indicia can be revealed simply by applying frictional heat to the chromogenic coating, such as by quickly rubbing or striking a human fingernail across the latent image indicia, to form visible colored indicia, whereby the chromogenic composition is activated by frictional heat. The expression "strike" as used in the present application is in the sense that one strikes a match across a rough surface to generate frictional heat. In the present invention, striking or quickly moving the human fingernail or other frictional heat generating stylus across and in contact with the chromogenic composition generates sufficient frictional heat to cause visible color formation.

According to another embodiment of the present invention, heat is applied to the chromogenic coating by means of a radiant or convective heat source, such as the heat emanating from an ordinary light bulb used for reading, for example, a 100 watt light bulb, or from a hand-held electric hair dryer, to cause visible indicia formation in the chromogenic composition. Likewise, heat can be directly applied by conduction using an electrically or otherwise heated element such as a flat metal plate having, for example, a rectangular shape the shape and size of the information area.

In a preferred embodiment of the present invention, the heat activatable chromogenic composition comprises a color forming chromogenic compound and a color developer material. In an especially preferred embodiment of the invention, a heat fusible material is also included in the chromogenic composition to lower the melting point of the color developer material. Preferably, the color developer material is a normally solid, acidic organic compound having a melting temperature between about 40° C. and about 200° C. so that the developer will melt or soften sufficiently by frictional heat or heat supplied by a relatively low heat generating device, such as an electric light bulb or hair dryer, to react with the chromogenic compound to produce a visible colored image. The latent image indicia can be made visible by applying heat, for example, by quickly rubbing or striking a fingernail, paper clip, coin, pen or other implement across the chromogenic composition to produce sufficient frictional heat, or by applying convective, radiant or conductive heat to the verification area to produce the visible colored image.

According to a preferred embodiment of the present invention, the chromogenic composition comprises a first layer comprising a latent image indicia, such as the numerals "123456" formed of the color developer material printed over a layer or coating including the chromogenic compound. Alternatively, the latent image can be printed using the chromogenic compound on a coating or layer of the color developer material to form the heat activatable latent image indicia. By applying heat, e.g., frictional heat, to the chromogenic composition, the chromogenic compound and the color developer react to produce a visible, colored image in the form of the numeric indicia, for example.

According to a further embodiment of the invention, the hidden entry system comprises a support bearing the chromogenic composition in the form of an autogenous mixture of solid particles of the chromogenic compound and the color developer material printed on the support to provide latent image indicia. Preferably, a fingernail or blunt instrument having a low heat conductivity is rubbed or struck quickly across the latent image to produce sufficient heat to provide a visible colored image of the indicia.

According to another embodiment of the present invention, the information area may be treated to conceal the latent image indicia. Despite use of the present colorless or chromogenic hidden entry system, light reflection can reveal the latent image indicia. According to this embodiment of the invention, the latent image indicia is coated with a thin coating comprising pigment in a binder which conceals the latent image without substantially reducing frictional heat activatable color development nor frictional heat activation characteristics of the chromogenic composition. Alternatively, concealment of the latent image of the chromogenic coating may be accomplished by dot printing the information area using conventional printing inks in any color other than that of the latent image. Since the chromogenic coating is colorless, application of the thin pigmented coating or dot printing may be accomplished prior to application of the chromogenic coating, if desired.

As used in the present application, the term "indicia" is used to include any number, letter or symbol in a general sense.

Other objects, advantages and salient features of the present invention will become apparent from the following detailed description, which, taken in conjunction with the annexed drawings, discloses preferred embodiments of the invention.

BRIEF DESCRIPTION OF THE DRAWINGS

Referring now to the drawings which form a part of this original disclosure.

DETAILED DESCRIPTION OF THE INVENTION

Figure 1:
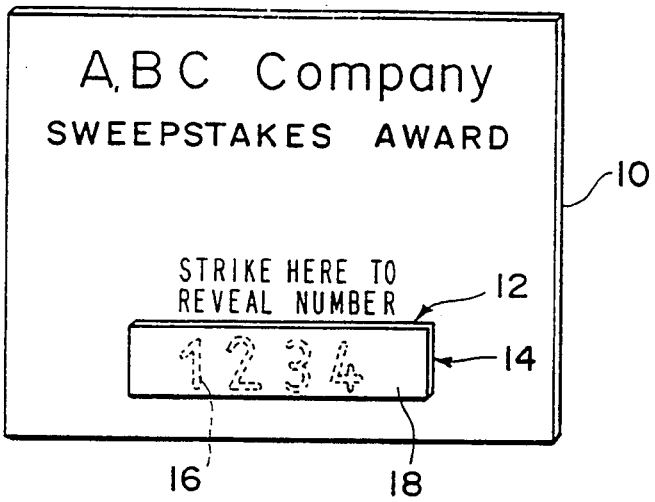
FIG. 1 is a front perspective view of a sweepstakes document showing the hidden entry area on the front face of the document.

Referring to the drawings, FIG. 1 illustrates a hidden entry system in combination with document 10.

The term "document" as used herein is intended to include any type of document or paper used to secret indicia until it is desired to reveal such indicia, including lottery tickets, sweepstakes, raffles, prizes and awards.

In the embodiment illustrated in FIG. 1, document 10 is a sweepstakes award having an information area 12 comprising a localized coating of a chromogenic composition 14. A chromogenic compound is formed into a colorless ink and printed to form, as combination 16, numerals "1234", as latent image indicia on the information area 12. Of course, any indicia, including alphanumeric, symbols or design indicia may be imprinted in lieu of the numerals 16. A localized coating 18 comprising a color developer is then coated over the chromogenic compound-printed numerals 16 to form the image-forming chromogenic coating 14. In alternative embodiments, the color developer may be applied as the printed latent image message 16 followed by the chromogenic compound as coating 18 according to the process described in U.S. Pat. No. 4,425,386 to Chang. The color reactants may be dissolved or dispersed in a vehicle such as a printing ink base, and the resulting solution printed onto the substrate. Although color developer may be printed to form the latent image, it is generally preferred to produce the latent image from the chromogenic compound.

The chromogenic compound in preferred embodiments is colorless before reacting with the color developer to produce the colored image. Suitable chromogenic compounds include diarylmethanes, triarylmethanes, indolylphthalides, azaphthalides, fluorans, and spiropyrans. Exemplary diarylmethanes include 4,4'-bis(dimethylaminobenzhydrylbenzyl)ether, N-halophenyl leuco auramine, and N-2,4,5-trichlorophenyl leuco auramine. Examples of triarylmethanes include 3,3-bis(p-dimethylaminophenyl)-6-dimethylaminophthalide and 3,3-bis(p-dimethylaminophenyl)phthalide. Examples of indolylphthalides include 3-(p-dimethylaminophenyl)-3-(1,2-dimethylindole-3-yl)phthalide and 3-(p-dimethylaminophenyl)-3-(2-methylindole-3-yl)phthalide. Examples of azaphthalides include 3-(2-ethoxy-4-diethylaminophenyl)-3-(1-octyl-2-methylindole-3-yl)-4-azaphthalide and 3-(2-ethoxy-4-diethylaminophenyl)-3-(1-ethyl-2-methylindole-3-yl)-4-azaphthalide. Examples of fluorans include 2-dibenzylamino-6-diethylaminofluoran, 2-anilino-6-diethylaminofluoran, 3-methyl-2-anilino-6-diethylaminofluoran, 2-anilino-3-methyl-6-(ethyl-isopentylamino)fluoran, 2-anilino-3-methyl-6-dibutylaminofluoran, 2-chloro-3-methyl-6-diethylaminofluoran, 3,6-dimethoxyfluoran, and 7,7'-bis(3-diethylaminofluoran). Examples of spiropyrans include 3-methylspirodinaphthopyran, 3-ethylspirodinaphthopyran, 3,3'-dichlorospirodinaphthopyran, 3-benzylspirodinaphthopyran, and 3-methylnaphtho-(3-methoxybenzo)spiropyran.

The preferred color developers are acidic compounds which have melting or softening points of about 40° C. to about 200° C. In preferred embodiments of the invention, the lower melting point developers having melting or softening points preferably from about 40° C. to about 140° C., with a range of from about 50° C. to about 80° C. being especially preferred, so that the colored image is easily formed by applying frictional heat or similar low temperatures. The developer melting point should, however, be sufficiently high to avoid melting and thus premature activation and formation of the colored image during drying of the coating, shipping and handling of the document.

Examples of useful color developers include: 4,4'-isopropylidenediphenol, 4,4'-isopropylidene-bis(2-tert-butylphenol), 4,4'-sec-butylidenediphenol, 2,2'-methylene-bis( 4-chlorophenol), phenol-formaldehyde novolak resin, alpha-naphthol, beta-naphthol, p-hydroxybenzyl benzoate, 3,5-dimethyl-4-hydroxybenzoic acid, 3-isopropylsalicylic acid, 3-benzylsalicylic acid, 3,5-di-tert-butylsalicylic acid, 1,5-di(4-hydroxyphenylthio)-3-oxapentane, 4-hydroxy-phenyl-4'-isopropoxyphenylsulfone, bis(3-allyl-4-hydroxyphenyl) sulfone, 4,4'thiodiphenol, and 3,3'-dimethyl-4,4'thiodiphenol.

The proportions of chromogenic compound and color developer in the coating varies according to the required color density of the image. Generally, about 1 to 50 parts by weight, and preferably about 1 to 10 parts by weight, of color developer is used per part by weight of chromogenic compound to produce a colored image with sufficiently sharp contrast to readily distinguish the colored image from the principal image. If desired, however, the colored image may be the same as the principal image, i.e., other printed matter on the document.

When the color developers have a high melting point, a heat-fusible material may be used in the chromogenic composition to lower the activation point or temperature of the color developer to facilitate the color development. Exemplary heat-fusible materials include stearic acid amide, stearic acid methylene bisamide, oleic acid amide, palmitic acid amide, coconut fatty acid amide, monoethanolamide of fatty acid, dibenzyl terephthalate, p-benzyl biphenyl, beta-naphthol benzyl ether, ethylene glycol-m-tolyl ether, di(p-chlorobenzyl) oxalate, and di(p-methylbenzyl) oxalate.

The chromogenic coating composition may also contain one or more inorganic or organic fillers, such as kaolin, talc, titanium dioxide, calcium carbonate, magnesium carbonate, barium carbonate, aluminum hydroxide, zinc oxide, silicone oxide, urea-formaldehyde resin, styrene-methacrylic acid copolymer, polystyrene resin, polycarbonate resin, polypropylene resin. The amount of filler used may vary depending on the chromogenic compound, developer and support material. The filler material is included as an extender material to reduce the amount of chromogenic compound and developer used and may be used to enhance the film-forming qualities of the chromogenic coating. The amount of filler material incorporated into the chromogenic coating composition should not substantially interfere with the development of the colored image.

A suitable binder material is needed to adhere the chromogenic compound and the color developer onto the substrate. The amount of binder generally used is about 10% to about 50% by weight, and preferably about 15% to about 35% by weight, based on the total weight of the solids of the coating composition. Examples of useful binders include starch, hydroxyethyl cellulose, methyl cellulose, carboxymethyl cellulose, gelatin, casein, gum arabic, polyvinyl alcohol, styrene-maleic anhydride copolymers, ethylene-acrylic acid copolymers, styrene-butadiene copolymers, acrylonitrile-butadiene copolymers, vinyl acetate emulsions, ethylene-vinyl acetate emulsions.

The heat activatable chromogenic composition of the present invention may optionally additionally contain a color suppressant to prevent premature coloration. The color suppressant must be so chosen that it will not inhibit or adversely affect the color formation in the final product. Examples are ammonium hydroxide, alkanolamines, such as monoethanol amine, diethanolamine, N, N-dimethylethanolamine, and the like, condensates of amine-formaldehyde, such as urea-formaldehyde, melamine-formaldehyde, and the like. Suitable amounts of such color suppressants include from about 0.1 to about 10, preferably from about 0.5 to about 4 percent by weight based on the total dry weight of the coating composition. Other suitable color suppressants are disclosed, for example, in U.S. Pat. Nos. 4,010,292 and 4,170,483, which are hereby incorporated by reference.

The chromogenic coating composition may be prepared by a number of methods as known in the art. A preferred method of preparing the coating composition is to disperse one or more of the reactants into a volume of water as a dispersing medium. The reactants are generally ground for about one hour to a particle size of about 1 to 10 microns in diameter. The reactants may be ground in the presence of dispersants or binders. Examples of suitable dispersants include sodium dioctylsulfosuccinate, sodium dodecylbenzene sulfonate, alginates and fatty acid metal salts. The binder material may also function as a protective colloid to disperse the reactants. The chromogenic compound and the color developer may be mixed together and applied as one coating or prepared as separate coating compositions and printed or applied in layers as discussed hereinafter in greater detail. The reactants are then ground or pulverized in a suitable device such as, for example, a ball mill, sand mill or attritor.

The information area comprising the localized coating of a chromogenic composition may be treated so as to conceal location of the latent image message, since light reflection can reveal location of the message of the verification system. Thus, the latent image message can be coated with a thin coating comprising pigment in binder which conceals the latent image message without substantially reducing heat activated color development or heat activation characteristics of the chromogenic coating. A suitable coating may comprise, for example, inorganic fillers, such as calcium carbonate, titanium dioxide, talc, clay, or the like, in a polyvinyl alcohol solution. The thin coating provides the same texture to the support as the coating forming the latent image message and, thus, effectively conceals the message. Alternatively, concealment of the latent image message of the chromogenic coating may be accomplished by dot printing the latent image message or the entire surface of the document including the verification area using conventional printing inks in any color other than that of the latent image. Since the chromogenic coating is colorless, the pigmented coating or dot printing may be applied either prior to or after application of the chromogenic coating to the substrate.

The chromogenic coating composition is applied to the substrate, for example, paper, plastic, or the like, which forms the document by any suitable technique as known in the art. The entire substrate may be coated although in preferred embodiments a localized, spot or band coating is used. The coating may be coextensive with just the information area or may be extended into principal image areas, if desired, since the coating is non-pressure sensitive and not affected by the pressure applied when the document is printed to supply additional information. In one embodiment of the invention, the chromogenic coating composition is prepared as a slurry comprising the chromogenic compound and the color developer. A preferred method of coating is by off-set gravure coating as disclosed in U.S. Pat. No. 4,425,386 to Chang which is hereby incorporated by reference. Alternative preferred coating methods include flexographic, screen printing, nozzle extrusion and ink jet printing.

Preferably, the chromogenic coating material is activated by quickly rubbing a blunt implement across the information area to generate sufficient frictional heat to produce a colored image. For convenience, a suitable implement may be a fingernail rubbed quickly across the verification area to generate frictional heat and produce a colored line. Other implements which may be used include a non-writing end of a pen, a stylus, paper clip, coin and the like. Generally, metal objects are not as effective in producing a colored image since the metal conducts the frictional heat quickly away from the point of contact and has a lower friction coefficient than many other objects. Thus, a fingernail or plastic object is generally preferred.

Figure 2:
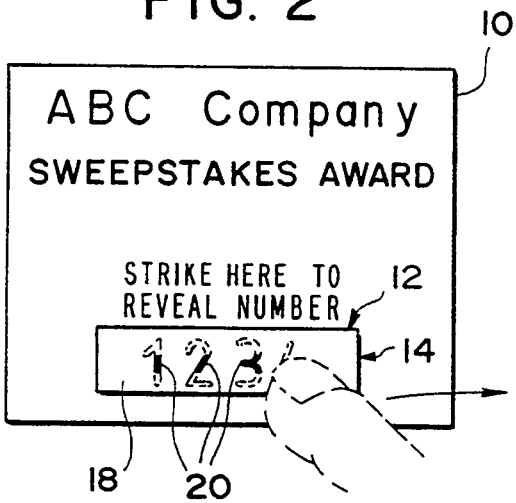
FIG. 2 is a schematic view of the sweepstakes document of FIG. 1 after applying frictional heat to a portion of the hidden entry area.
Figure 3:
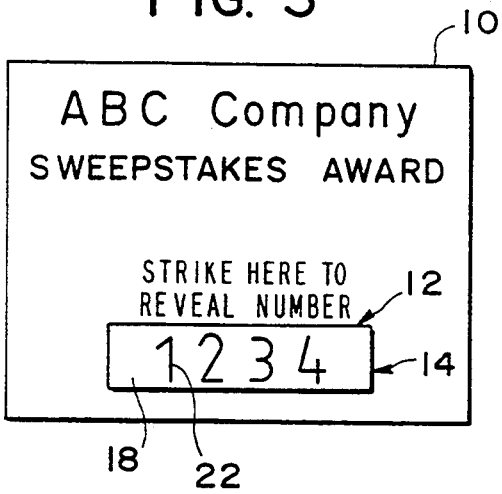
FIG. 3 is a schematic view of the sweepstakes document of FIG. 1 having the previously hidden image completely displayed to reveal the participant's number.

Referring again to FIG. 1, the hidden entry system of the present invention is activated by applying frictional heat, such as by quickly rubbing the verification area with a fingernail as illustrated in FIG. 2, or other blunt object. A single stroke across and in contact with the chromogenic composition 14 will supply sufficient frictional heat to cause the chromogenic compound latent image 16 to react with overlying color developer 18 and partially convert the latent image 18 to a visible colored image in the form of colored segments 20 as shown in FIG. 2. Applying repetitive strokes across composition 14 will cause the entire visible image 22 to develop as shown in FIG. 3.

Information area 12 in the embodiment of FIG. 1 is positioned in the lower center of the front face of the sweepstakes document. It is to be understood that the information area 12 comprising chromogenic composition 14 may be located in any position or area on the document and that multiple localized coating of such chromogenic compositions may be present on the front of the document and on both the front and back of the document, as desired.

In the embodiment of FIG. 1, latent image 16 is in the form of numerals. In alternative embodiments, the latent image can be, for example, a business logo, design, diagram, serial number, winning number, combinations of numbers and letters, or other indicia.

Figure 4:
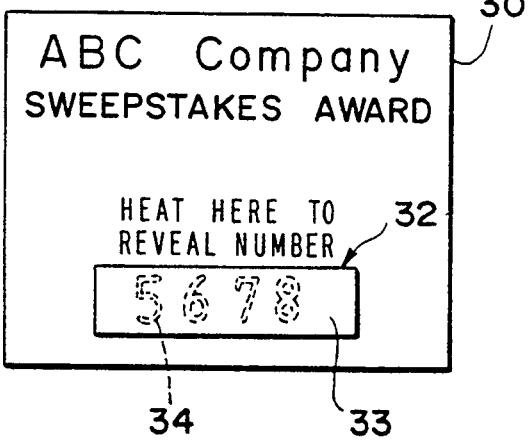
FIG. 4 is a front view of a sweepstakes document showing the hidden entry area provided by an autogenous latent image.

Referring now to FIG. 4, a sweepstakes document 30 is shown having information area 32. A red color-yielding autogenous mixture of chromogenic compound and color developer is coated onto information area 32 as localized or spot coating 33. Latent image 34 is provided in information area 32 by printing a black color yielding mixture of the chromogenic compound and color developer onto the coating 33, thereby providing a localized, autogenous, heat activatable latent image coating 34 in the form of numerals "5678". While the latent image of indicia of FIG. 4 may be activated by frictional heat, any suitable means for applying sufficient heat, whether frictional or otherwise, can be used to heat the black and red-yielding chromogenic compositions and produce visible colored images. The heat providing means should be capable of heating the chromogenic composition to a temperature of between about 40° C. to 200° C., preferably between about 40° C. or 50° C. to about 110° C. or 140° C., with between about 50° C. and about 80° C. being especially preferred. Thus, latent image 34 of FIG. 4 is activated and converted to black visible image 38 while coating 33 is activated and converted to red visible image 39 in FIG. 5 using heat supply 40 which may include, for example, heat sources such as ordinary electric light bulbs, for example, 80–150 watt bulbs, hand-held electric hair dryers, or the like. Similarly, a heated metal element, such as a flat plate-like element for direct application of heat to the latent image, could be used.

If a fingernail were quickly drawn across the coating of FIG. 4 to supply frictional heat in the manner of FIG. 2, the visible portions of the numerals 34 would appear red, and the visible portions of the background would appear black, yielding a visible line with red and black segments.

Figure 5:
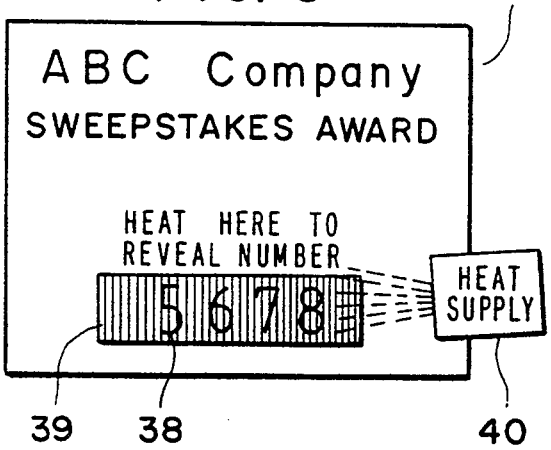
FIG. 5 is a schematic of the sweepstakes document of FIG. 4 after applying heat from a radiant or convection heat source.

Although the embodiment of FIGS. 4–5 use two autogenous coatings to provide colored indicia with a contrasting colored background, it is understood that coating 33 in FIG. 4 could be omitted such that only the black indicia 38 would appear upon heat activation in FIG. 5 with no red background 39, if desired. In such event, each numeral "5, 6, 7 and 8" in FIG. 4 would constitute a localized autogenous coating of a heat activatable chromogenic composition providing a latent image of indicia.

In preferred embodiments, the color developer has a melting or softening point of about 40° C. to about 200° C., preferably from about 40° C. or 50° C. to about 110° C. or 140° C., especially 50° C. to about 80° C., so as not to react with the chromogenic reactant at room temperature. Application of heat at temperatures in the range of 40° C. to about 200° C. softens or melts the developer rendering it sufficiently mobile to mix and react with the chromogenic compound and produce the distinct visible colored image in situ. Since the reactants are solids at room temperature, no physical separation of the reactants is necessary in the coating. The reactants can be mixed together as a slurry and coated on the document to form an autogenous latent image. The chromogenic coating is activated by heat and the coating is non-pressure sensitive.

To have an eye catching result to reveal award information, for example, it is desirable for the autogenous chromogenic coating to present a striking color contrast to other printed matter on the document. For example, the autogenous latent image can be heated to yield red, violet, orange, green, blue, or yellow to obtain a high degree of contrast. Alternatively, the developed color can be coordinated with the requirements of the institution circulating the document, and may be, for example, the same color as the printed matter on the document. Of course, in the case of a form used for a sweepstake award, or the like, highly contrasting colors can be used, and multiple autogenous chromogenic coatings each producing a different colored visible image can be used in the information area.

When the present invention is used to provide lottery tickets or sweepstakes awards, for example, the latent image indicia of the hidden entry system of the present invention will normally be a numerical sequence on each ticket or form which varies from form to form depending upon the number of winners in each category, for example.

Figure 6:
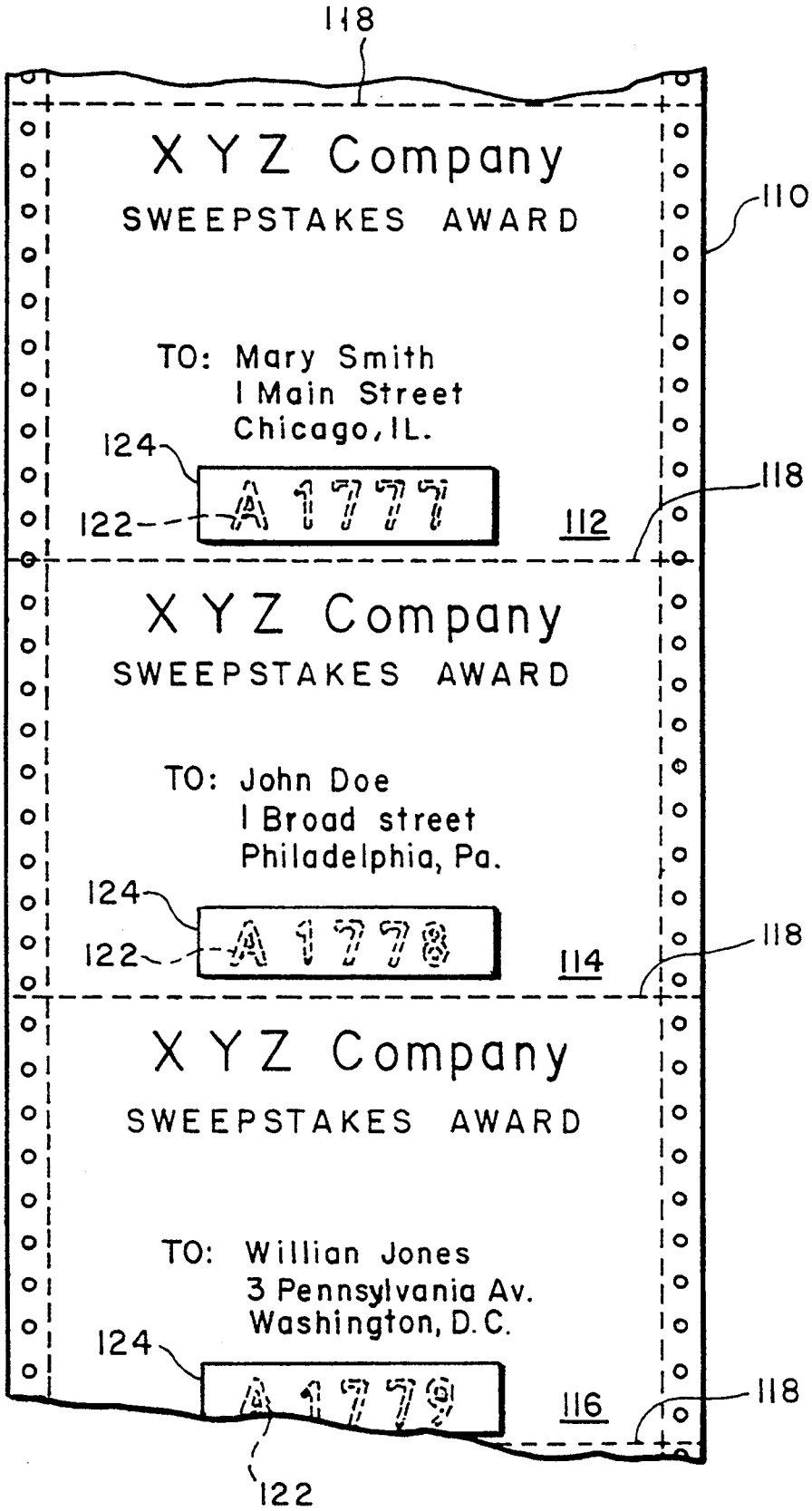
FIG. 6 is a top plan, partially sectioned view of a multi-ply sweepstakes form.

Referring now to FIG. 6, form 110 comprises a plurality of sweepstakes award forms 112, 114, 116 separated by perforated lines 118. Each individual form has sequences of predetermined indicia printed thereon with the heat activatable chromogenic composition to form latent images 122 of indicia, in which at least a portion of the forms have sequences of latent image numbers which differ from form to form or ticket to ticket. Latent image 122 may be formed from, for example, an autogenous mixture of red color producing chromogen and color developer. Likewise, latent image 122 may be printed from a chromogen followed by a coating 124 of a color developer, as desired. The forms are joined end to end for easy passage through a computer printer adapted to print varying sequences of latent image numbers with the heat activatable chromogenic composition of the present invention. The forms are then separated and mailed or otherwise distributed as desired.

The invention will be further illustrated by the following example. It should be understood that it is not intended to limit the scope of this invention.

EXAMPLE

A chromogenic composition is prepared from a mixture of 25 grams of 7,7'-bis(3-diethylaminofluoran) and 85 grams of calcium carbonate in 275 grams of a 10% aqueous polyvinyl alcohol solution. The mixture is ground in an attritor for one hour to reduce the size of the particles and produce a dispersion.

A color developer is produced by mixing 80 grams of 4-hydroxy-4'-isopropoxyphenylsulfone and 20 grams of dibenzyl oxalate in 250 grams of 10% polyvinyl alcohol aqueous solution. The mixture is ground in an attritor for one hour to reduce the particle size of the components and produce a dispersion.

An autogenous chromogenic coating composition is prepared by mixing equal parts by weight of the chromogenic dispersion and the color developer dispersion, which could be printed. A spot is then coated on a document and allowed to dry. Striking the coating with a fingernail immediately produces a red-colored line.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather, only by the scope of the claims appended hereto.

What is claimed is:

1. A method for revealing hidden indicia on a contest form or promotional form, said form comprising a support having an information area bearing a localized coating of a heat activatable chromogenic composition, said heat activatable chromogenic composition comprising a chromogenic compound and a color developer, said heat activatable chromogenic composition providing a latent image of indicia, said latent image convertible to a visible colored image by application of heat;

applying heat to said heat activatable chromogenic coating thereby causing conversion of said latent image of indicia to a visible colored image of said indicia.

2. The method of claim 1, wherein said localized coating is frictional heat activatable and said visible colored image of indicia is formed by applying frictional heat to said localized coating of said heat activatable chromogenic composition.

3. The method of claim 1, wherein said visible colored image is formed by applying radiant heat to said localized coating of said heat activatable chromogenic composition.

4. The method of claim 1, wherein said visible colored image is formed by applying heat by convection to said localized coating of said heat activatable chromogenic composition.

5. The method of claim 1, wherein said visible colored image is formed by applying heat by conduction to said localized coating of said heat activatable chromogenic composition.

6. The method of claim 1, wherein said localized heat activatable chromogenic composition comprises an autogenous mixture of a chromogenic compound and a color developer.

7. The method of claim 1, wherein said chromogenic composition comprises a first coating comprising a chromogenic material and a second coating comprising a color developer, said first and second coatings being superposed on said support.

8. The hidden entry system of claim 7, wherein said first and second coatings are non-coextensive and the less extensive coating comprises a latent image which becomes visible indicia upon application of heat.

9. The method of claim 1, wherein said chromogenic coating is heated to a temperature of between about 40° C. and about 200° C. to convert said latent image to a visible colored image.

10. The method of claim 9, wherein said chromogenic coating is heated to a temperature of between about 50° C. and about 80° C. to convert said latent image to a visible colored image.

11. The method of claim 1, wherein said indicia is numerical indicia.

12. The method of claim 1, wherein said chromogenic composition is substantially colorless prior to application of heat.

13. A hidden entry system comprising a document which comprises:

a support having an information area bearing a localized coating of a heat activatable chromogenic composition, said heat activatable chromogenic composition comprising a chromogenic compound and a color developer which can react to form a visible colored image, said heat activatable chromogenic composition providing a latent image of indicia, said latent image convertible to a visible colored image of said indicia by application of heat.

14. The hidden entry system of claim 1, wherein said chromogenic composition comprises a first coating comprising a chromogenic material and a second coating comprising a color developer, said first and second coatings being superposed on said support.

15. The hidden entry system of claim 14, wherein said first and second coatings are non-coextensive and the less extensive coating comprises a latent image which upon application of heat becomes visible indicia.

16. The hidden entry system of claim 1, wherein said chromogenic compound and said color developer are present in a mixture to form an autogenous latent image of indicia convertible to visible indicia upon application of heat.

17. The hidden entry system of claim 13, wherein said latent image is heat activatable to a visible image at a temperature in the range of between about 40° C. and about 200° C.

18. The hidden entry system of claim 17, wherein said latent image is heat activatable to a visible image at a temperature in the range of between about 50° C. and about 80° C.

19. The hidden entry system of claim 13, wherein said document is a sweepstake ticket, lottery ticket, promotional award or contest form.

20. The hidden entry system of claim 13, wherein said information area bears first and second localized coatings of heat activatable chromogenic compositions, said first and second localized coatings being non-coextensive, and upon heating said first localized chromogenic coating providing a visible image of a first color and said second visible image providing a visible image of a second color, said first localized coating of a heat activatable coating forming said latent image of indicia.

21. The hidden entry system of claim 20, wherein said second localized heat activatable chromogenic coating surrounds said first localized heat activatable chromogenic coating.

22. The hidden entry system of claim 21, wherein said first color is red and said second color is black.

23. The hidden entry system of claim 13, wherein said system comprises a plurality of documents comprising a support having an information area bearing a localized coating of a heat activatable chromogenic composition, said heat activatable chromogenic composition providing a latent image of indicia, said latent image convertible to a visible colored image of said indicia by application of heat, at least a portion of said plurality of document having indicia varying from document to document.

24. The hidden entry system of claim 23, wherein said indicia on each document comprises a numerical sequence, which sequence differs from document to document for at least a portion of said plurality of documents.

25. The hidden entry system of claim 23, wherein said plurality of documents comprises a series of forms joined end to end.

26. The hidden entry system of claim 25, wherein said document is a sweepstake ticket, lottery ticket, promotional award or contest form.

27. The hidden entry system of claim 23, wherein said latent image is heat activatable to a visible image at a temperature in the range of between about 40° C. and about 200° C.

28. The hidden entry system of claim 27, wherein said latent image is heat activatable to a visible image at a temperature in the range of between about 50° C. and about 80° C.

29. The hidden entry system of claim 23, wherein each said document has a plurality of information areas each of which bear a localized coating of a heat activatable chromogenic composition.

30. The hidden entry system of claim 13, wherein said chromogenic composition is frictional heat activatable.

31. The hidden entry system of claim 13, wherein said chromogenic composition is substantially colorless prior to application of heat.

* * * * *